US011992127B2

(12) United States Patent
Zhou

(10) Patent No.: US 11,992,127 B2
(45) Date of Patent: May 28, 2024

(54) TOP POCKET SHEET FOR BEDDING

(71) Applicant: Mi Zhou, San Diego, CA (US)

(72) Inventor: Mi Zhou, San Diego, CA (US)

( * ) Notice: Subject to any disclaimer, the term of this patent is extended or adjusted under 35 U.S.C. 154(b) by 0 days.

(21) Appl. No.: 17/173,869

(22) Filed: Feb. 11, 2021

(65) Prior Publication Data

US 2022/0248865 A1 Aug. 11, 2022

(51) Int. Cl.

| | |
|---|---|
| ***A47C 21/02*** | (2006.01) |
| ***A47G 9/02*** | (2006.01) |
| ***A47G 9/04*** | (2006.01) |

(52) U.S. Cl.

CPC ..... *A47C 21/028* (2013.01); *A47G 9/0238* (2013.01); *A47G 9/04* (2013.01)

(58) Field of Classification Search

CPC ..... A47C 21/00; A47C 21/02; A47C 21/022; A47C 21/028; A47G 9/02; A47G 9/0238; A47G 9/04

See application file for complete search history.

(56) References Cited

U.S. PATENT DOCUMENTS

| | | | | |
|---|---|---|---|---|
| 5,836,023 | A * | 11/1998 | Stone Munson | A47G 9/0238 5/490 |
| 2010/0050341 | A1* | 3/2010 | Tepper | A47G 9/0261 5/501 |
| 2017/0071368 | A1* | 3/2017 | Pelaez | A47G 9/0238 |
| 2017/0127855 | A1* | 5/2017 | Wootten, Jr. | A47G 9/0261 |
| 2018/0255945 | A1* | 9/2018 | Stewart | A47G 9/04 |

FOREIGN PATENT DOCUMENTS

| | | | | |
|---|---|---|---|---|
| GB | 2558636 | A * | 7/2018 | A47G 9/0207 |

* cited by examiner

*Primary Examiner* — Fredrick C Conley
(74) *Attorney, Agent, or Firm* — Rimon PC

(57) ABSTRACT

The present application discloses an improved top sheet, referred to as Top Pocket Sheet (TPS). The TPS comprises a pocket for holding a comforter or blanket so that the comforter or blanket stays with the top sheet during a night of sleep. The pocket can be permanently or temporarily formed. The pocket can be secured to the top sheet via different means.

3 Claims, 8 Drawing Sheets

TOP POCKET SHEET FOR BEDDING

FIELD OF THE TECHNOLOGY

The present disclosure relates generally to bed linens, and more specifically to an improved top sheet for bedding, referred to as Top Pocket Sheet (TPS) in this disclosure.

BACKGROUND

The term "bed sheet" was first used in the 15th century. In the 20th century, people started to improve and file patents on how to make bed sheets more comfortable. Nowadays, a bedding set sold in stores normally includes a fitted sheet and a top sheet. The fitted sheet comes with an elastic band along the edge and is used to cover the mattress. The fitted sheet wraps around the mattress tightly because of the elastic band and stays in place even after a night of sleep. The top sheet is a loose and flat sheet intended to be used in between the comforter and a human body. The top sheet is loose so as not to restrict body movement. But because the top sheet is loose, it does not stay with the comforter. Often, after a night of sleep, the top sheet is cast aside or crumbled and stuffed into a corner.

U.S. Pat. Nos. 5,422,822; 4,425,365; 6,725,477; and 4,651,371 describe various top bed sheets with a folded portion that can be adapted to fit around the end of a mattress for a clean look. U.S. Pat. No. 8,689,373 B2 describes a contour sheet that does not easily slide off the mattress and remains flat and tightly attached to the mattress also for a clean look. U.S. Publication Nos. 2004/0200000 and 2006/0168726 describe fitted sheets with a fitted end. US Pub. No. 2011/0023234 A1 describes a flat top sheet having releasable corner fasteners that can secure the sheet to an underlying mattress. All previous patents or patent applications relate to top bed sheets that are intended to attach the sheet to the mattress or the bottom of the bed for a clean look when the bed is not used. They do not address the problem of slippage and displacement of the top sheet when people move around during sleep. The present application discloses an improved top sheet, TPS, designed to solve these problems.

SUMMARY

Accordingly, the present application discloses an improved bed sheet, TPS, that is designed to keep the sheet stay together with the comforter or blanket.

A TPS is designed to include a pocket for holding a comforter or blanket. The pocket may be formed by folding one end of the top sheet over and attaching two corners of the top sheet to the edge of the bed sheet. The pocket has an opening for receiving a comforter or blanket. The two sides of the pocket may be partially or fully closed. When the two sides are partially closed, each side of the pocket is left with a side opening, through which the comforter or blanket can be conveniently pulled or arranged.

In some embodiments, the height of the pocket, e.g., the length of the side, is between 12 and 20 inches. When the sides are partially closed, the length of the closed portion may be 4 to 5 inches long. The sides of the pocket can be sewed onto or otherwise securely attached to the edges of the bed sheet. In some embodiments, the attachment may be permanent. For example, the two corners of the folded end may be sewed or glued to the edge of the bed sheet. In other embodiments, the attachment may be temporary. For example, the two corners of the folded end may be buttoned onto the edge of the sheet. For another example, the two corners of the folded end may be attached to the edge of the bed sheet using snap fasteners, tie strings, Velcro stripes, or other adhesive mechanisms.

In some embodiments, the size of the pocket in the bed sheet may be adjustable, for example, ranging from 12 to 20 inches. In one embodiment, more than one snap fastener may be arranged along the sides of the bed sheet. When folded over, the two corners can be affixed to two selected snap fasteners that are aligned and located on either side of the bed sheet. The two snap fasteners may be selected from an array of snap fasteners that are located on both sides of the bed sheet to form a pocket of a preferred size.

The pocket formed at one end of the TPS receives a comforter or blanket and holds the comforter or blanket in place. In one embodiment, the comforter may be flatly inserted into the pocket. Alternatively, the comforter may be folded over along with the top sheet when the pocket is created. In this way, the comforter is folded inside the pocket to form a plush end.

In some embodiments, when the pocket is sewed onto the sheet, the seam may extend along the entire depth of the pocket. In other embodiments, the seam may be shorter than the depth of the pocket, leaving the pocket partially open. In some embodiments, an array of buttonholes is arranged along one side of the bed sheet and an array of buttons is arranged on the comforter. The distance from the button array to the edge of the comforter may range between 5 to 30 inches. When the sheet is folded over, it can be folded over along with or without the comforter. When folded over, the top sheet can be buttoned up to the comforter. The buttons may be hidden or visible depending on the aesthetic design.

In some embodiments, the pocket is formed by sewing or attaching a piece of fabric to the top sheet. The means of attachment can be any suitable means, for example, buttons, snap fasteners, etc. For aesthetic appeals, the piece of fabric and the comforter may be of matching color or pattern.

BRIEF DESCRIPTION OF THE DRAWINGS

These and other features of the present disclosure will become readily apparent upon further review of the following specification and drawings. In the drawings, like reference numerals designate corresponding parts throughout the views. Moreover, components in the drawings are not necessarily drawn to scale, the emphasis instead being placed upon clearly illustrating the principles of the present disclosure.

DETAILED DESCRIPTION

Embodiments of the disclosure are described more fully hereinafter with reference to the accompanying drawings, in which preferred embodiments of the disclosure are shown. The various embodiments of the disclosure may, however, be embodied in many different forms and should not be construed as limited to the embodiments set forth herein. Rather, these embodiments are provided so that this disclosure will be thorough and complete, and will fully convey the scope of the disclosure to those skilled in the art.

Conventionally, people use duvet cover to protect comforter, duvet, blanket, or other beddings. Comforters or duvets are often too thick and heavy to be washed or dry cleaned frequently. A duvet cover encases the entire comforter or duvet and is easy to use and wash. But a duvet cover is inconvenient to change, especially for king or queen size beddings. A conventional flat sheet may be used under a comforter to keep the comforter clean. A flat sheet is easy to change and wash, but is not easy to use because a flat sheet often slips away or gets displaced during sleep since the sheet is not attached to anything.

Instead of affixing the top sheet to a mattress or the bottom of the bed for display purposes as taught in prior art references, the present application discloses an easy method to help keep the top sheet staying together with a comforter or blanket or any other bedding that people would like to use for sleep.

Figure 1:
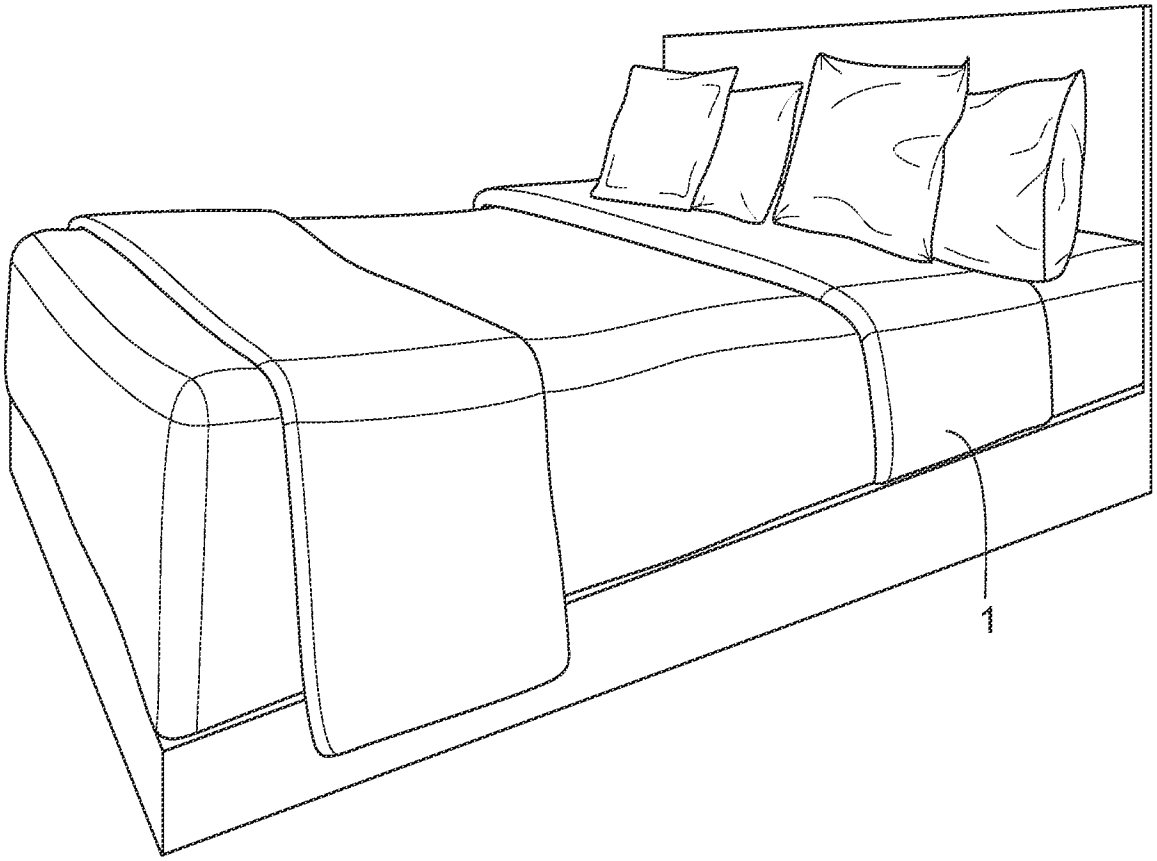
FIG. 1 is an illustration of a neatly made hotel bed with a conventional top sheet tucked under a mattress.

In referring to FIG. 1, a neatly made bed in a hotel room is shown. The top sheet 1 is folded over along with the blanket. The folded portion of the top sheet 1 is then tucked underneath the top mattress so the bed remains tidy and clean for display. At night, the top sheet is untucked and becomes loose for a good night's sleep. When untucked, the top sheet becomes rumpled and may be tossed aside. Common experience is that the top sheet would seldom stay between the comforter and the human body, making it less effective in protecting the comforter from being soiled or providing the soft feel against coarser materials commonly used in comforters.

Figure 2A:
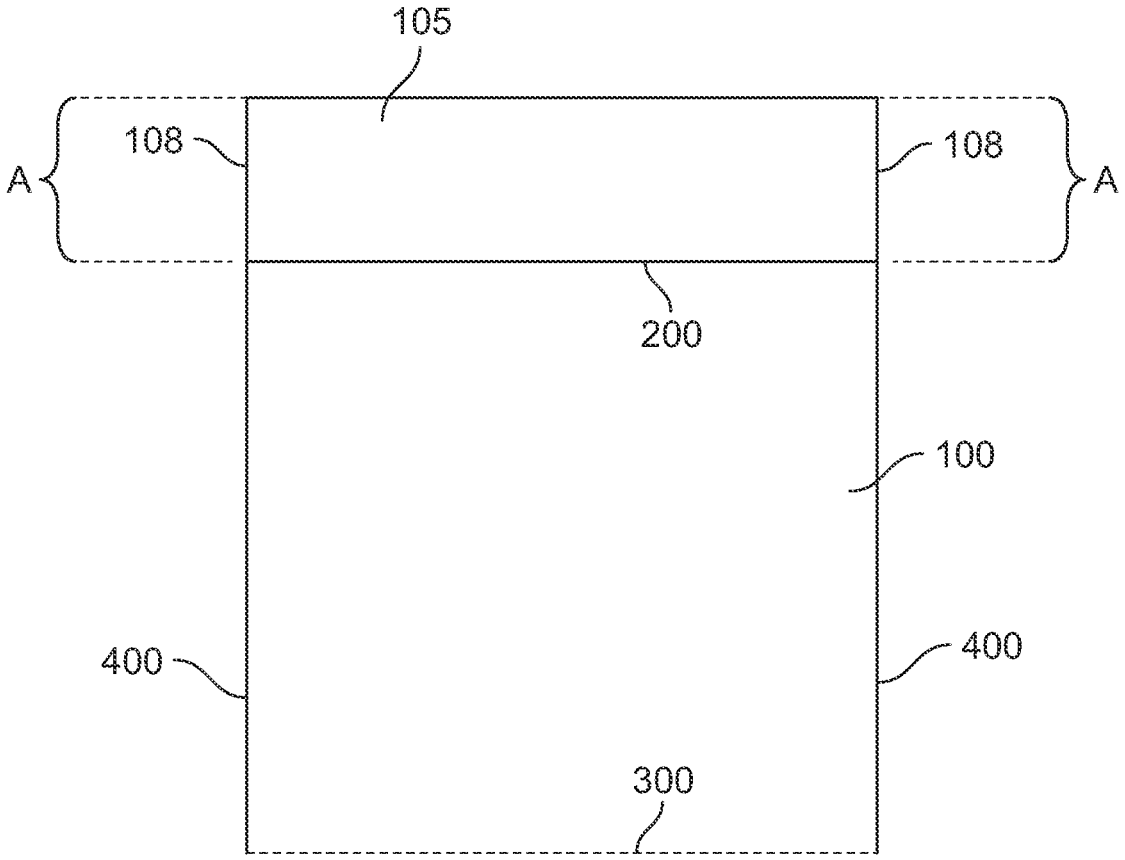
FIG. 2*a* shows an embodiment of the TPS having a pocket formed by folding over one end of the top sheet and attaching the corners of the folded end to the two sides of the bed sheet.

FIG. 2*a* illustrates a TPS 100 that can hold a comforter in place. The sheet has a top side 200, a bottom side 300, and two edges 400. The top side 200 is folded over to form a pocket 105. The pocket 105 is open along the top side 200. The edges 108 of the pocket 105 are secured or attached to the top sheet edges 400. For example, the pocket edges 108 are sewed to the top sheet edges 400.

Figure 2B:
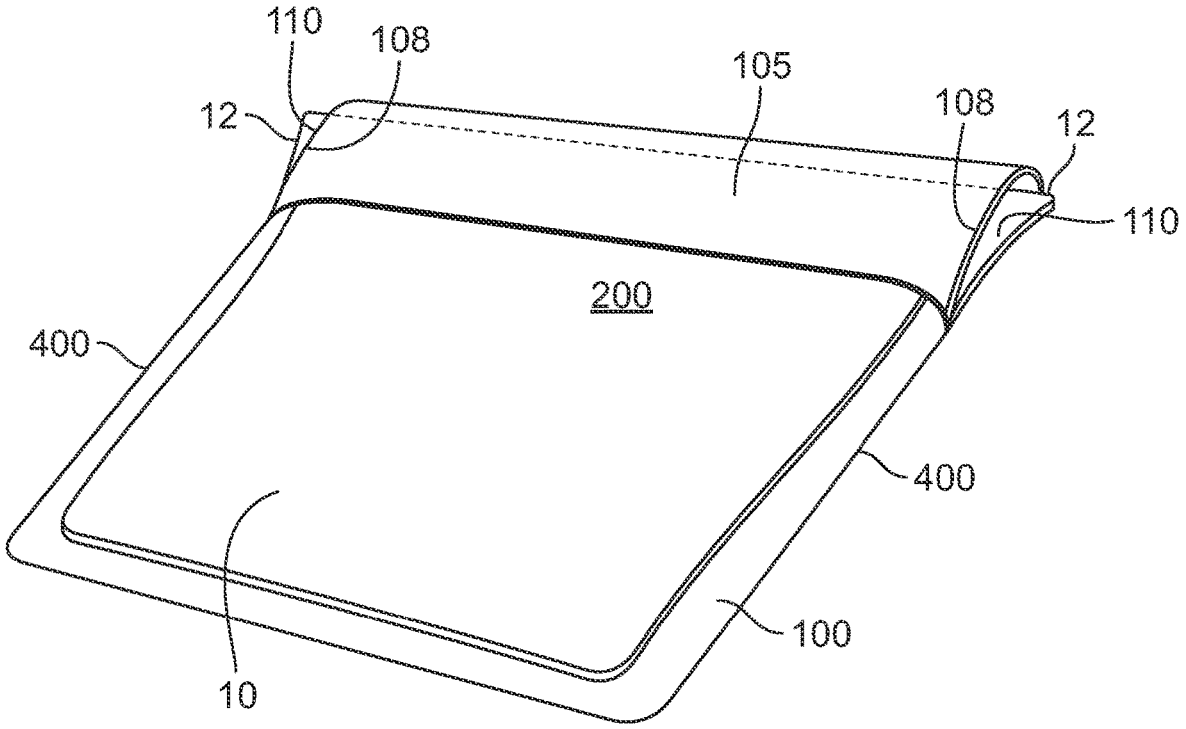
FIG. 2*b* illustrates a comforter being received inside the pocket of the TPS.

FIG. 2*b* illustrates how the TPS 100 can be used with a comforter 10. The TPS 100 comprises a pocket 105 that is partially closed on the side. The pocket has two side openings 110 on each side. Through the side openings 110, the comforter can be pulled into the pocket 105. In FIG. 2*b*, the two corners 12 of the comforter 10 stick out of the side openings 110. In some embodiments, the two corners 12 of the comforter 10 may be secured to the inside corners of the pocket 105 via buttons, strings, snap fasteners, etc.

Figure 3:
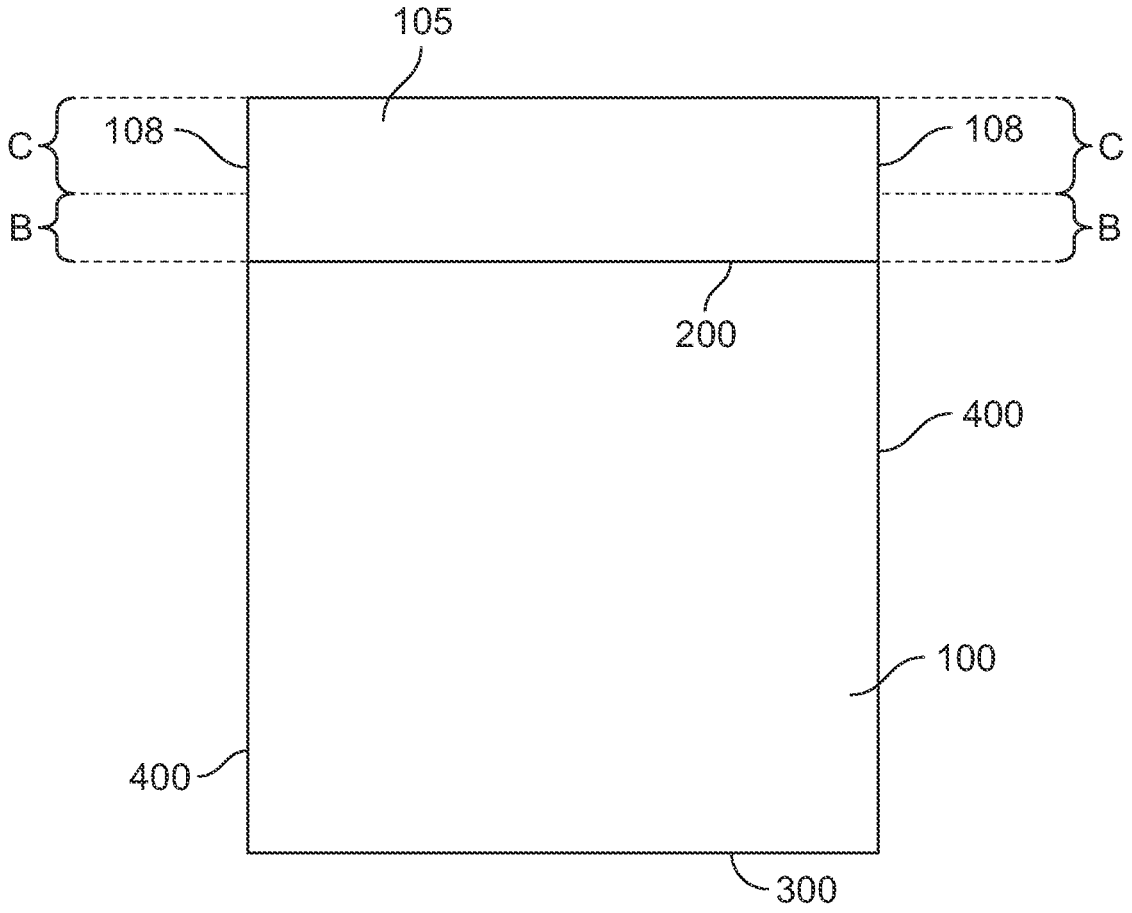
FIG. 3-FIG. 7 illustrate different embodiments of the TPS.

In one embodiment, the entire edge 108 (labeled A in FIG. 2*a*) is sewed to the sheet edge 400. In another embodiment shown in FIG. 3, the edge 108 is partially sewed to the sheet edge 400. For example, a portion of the edge 108 (labeled B in FIG. 3) is sewed to the sheet edge 400, leaving the other portion of the edge 108 (labeled C in FIG. 3) open.

Figure 4B:
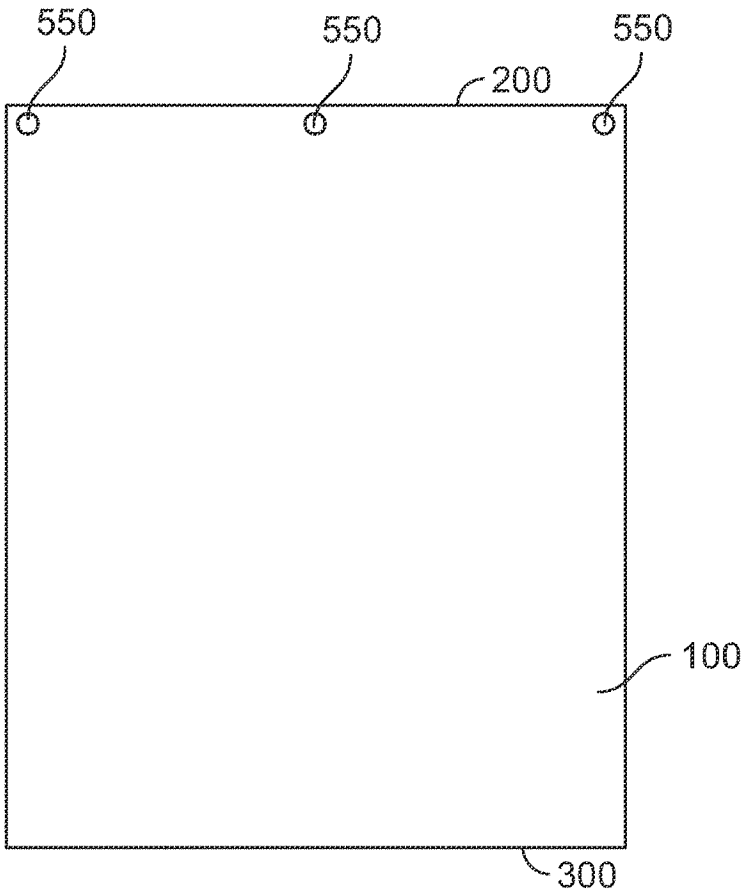
Figure 4A:
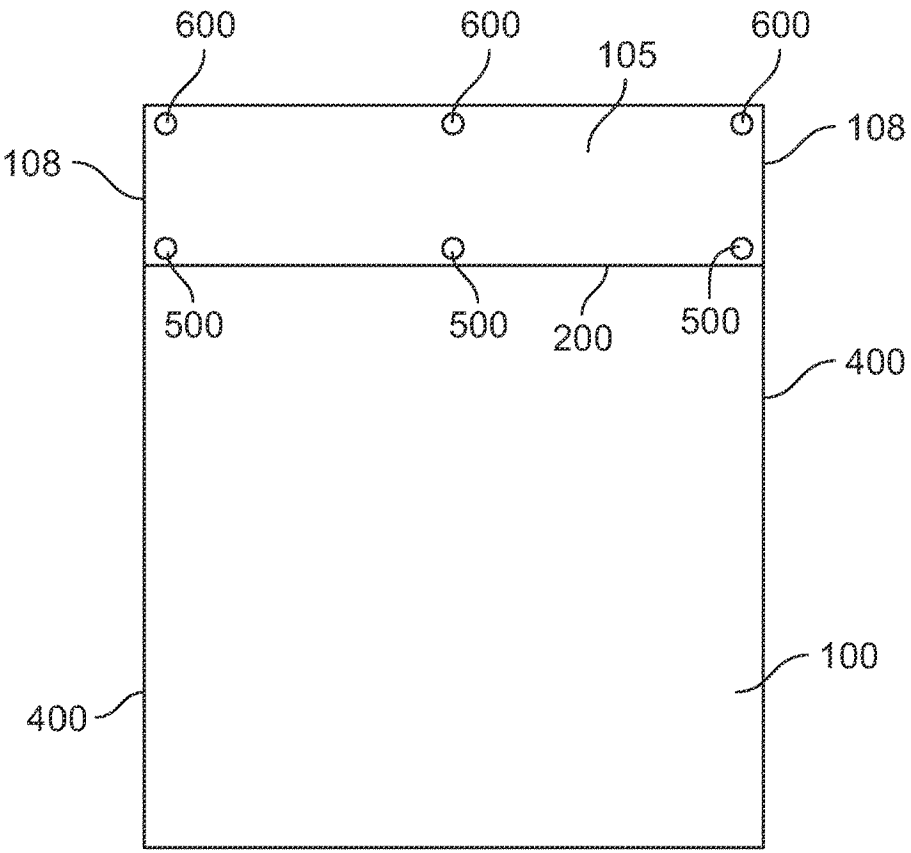

FIG. 4*a* and FIG. 4*b* depict yet another embodiment of the TPS. In this embodiment, the pocket is formed by buttoning. The top side 200 of the bed sheet has an array of buttonholes 550 shown in FIG. 4*b*. The comforter has an array of buttons 500. When folded over, the pocket 105 is formed by buttoning the top sheet to the comforter. Alternatively, the pocket may be formed by buttoning a piece of fabric to the comforter (FIG. 4*a*). The piece of fabric is rectangular, with two long sides and two short sides. The long side is of the same length as the top side 200 of the bed sheet. There is an array of buttonholes along one or both long sides of the fabric. The top side 200 of the bed sheet has an array of buttons 600 for the fabric to attach to the top side of the bed sheet and form a pocket 105 between the piece of fabric and the top sheet 100. Optionally, the comforter may have an array of buttons 500 for the piece of fabric to attach to and to close the pocket 105.

Figure 5:
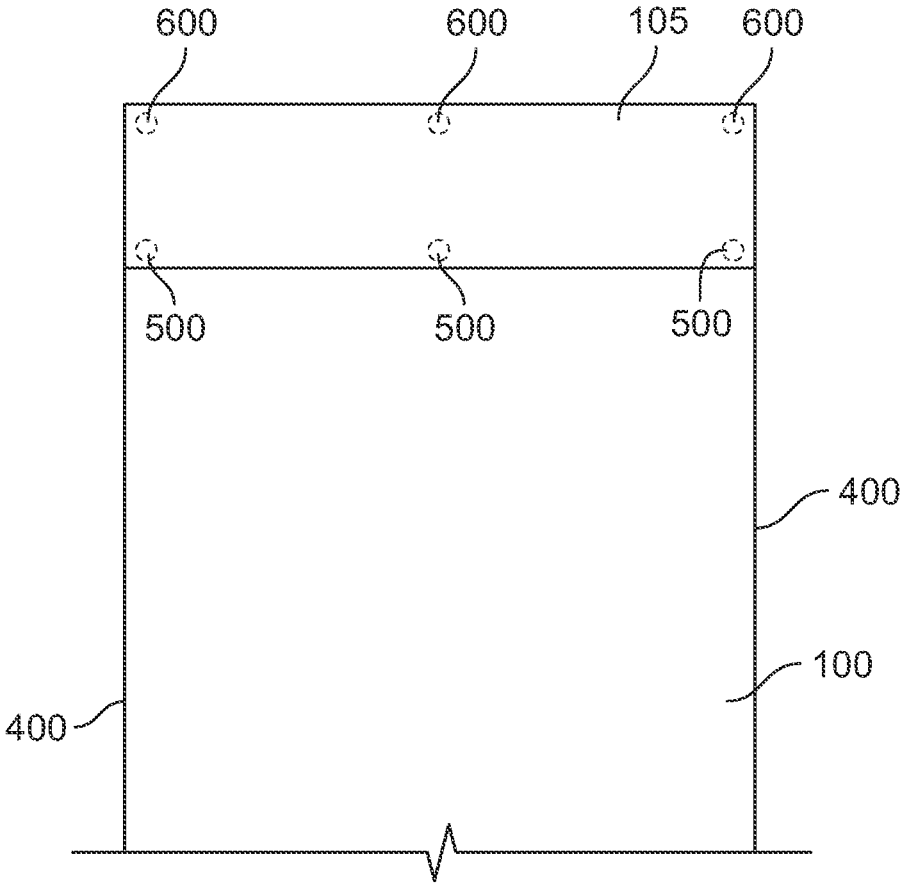

For different aesthetic appeals, the buttons 500 and 600 may be visible or hidden. FIG. 5 illustrates an embodiment in which the buttons 500 and/or 600 are hidden inside the pocket.

Figure 6B:
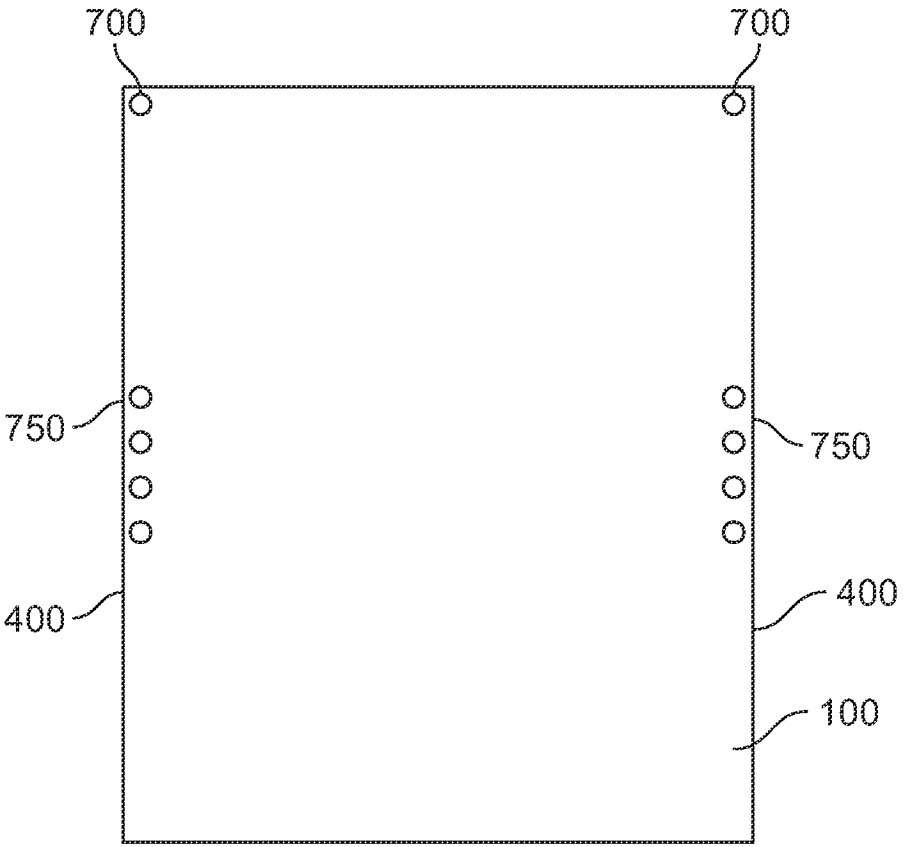
Figure 6A:
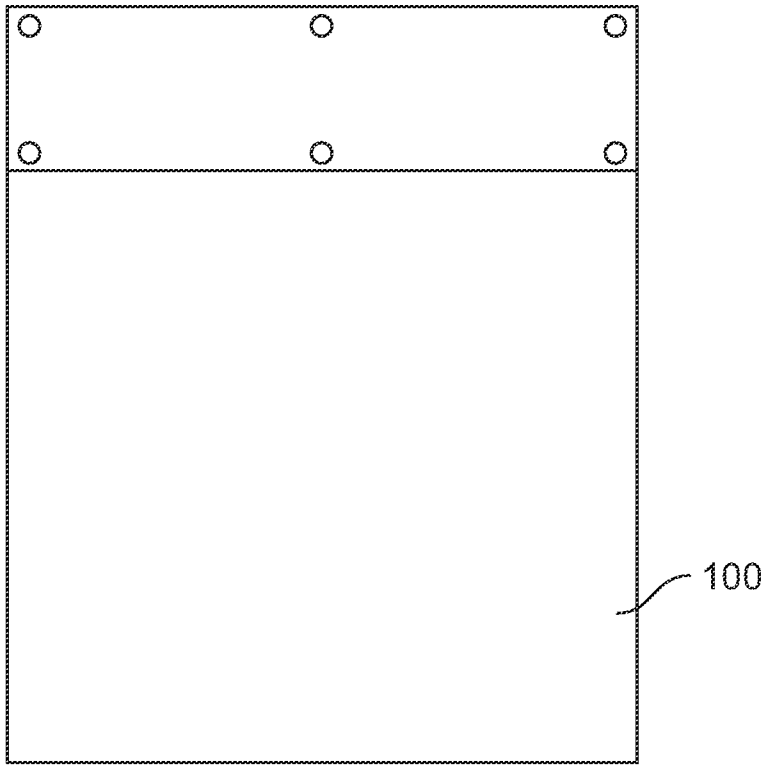

FIG. 6*a* is an illustration showing that the pocket 105 is secured or attached to the sheet 100 via means other than buttons. For example, the pocket may be formed using snap fasteners, strings, or Velcro stripes, etc., all of which may be made invisible by being placed on the inside of the pocket 105.

FIG. 6*b* illustrates an embodiment in which pockets 105 of different sizes can be formed according to user preference. In FIG. 6*b*, two snap fasteners 700 are located at the two top corners of the TPS 100. An array of snap fasteners 750 is arranged along the two edges 400 of the sheet 100. When folded over, the two top snap fasteners are pressed into two selected snap fasteners 750 to form a pocket of a desired size.

Figure 7:
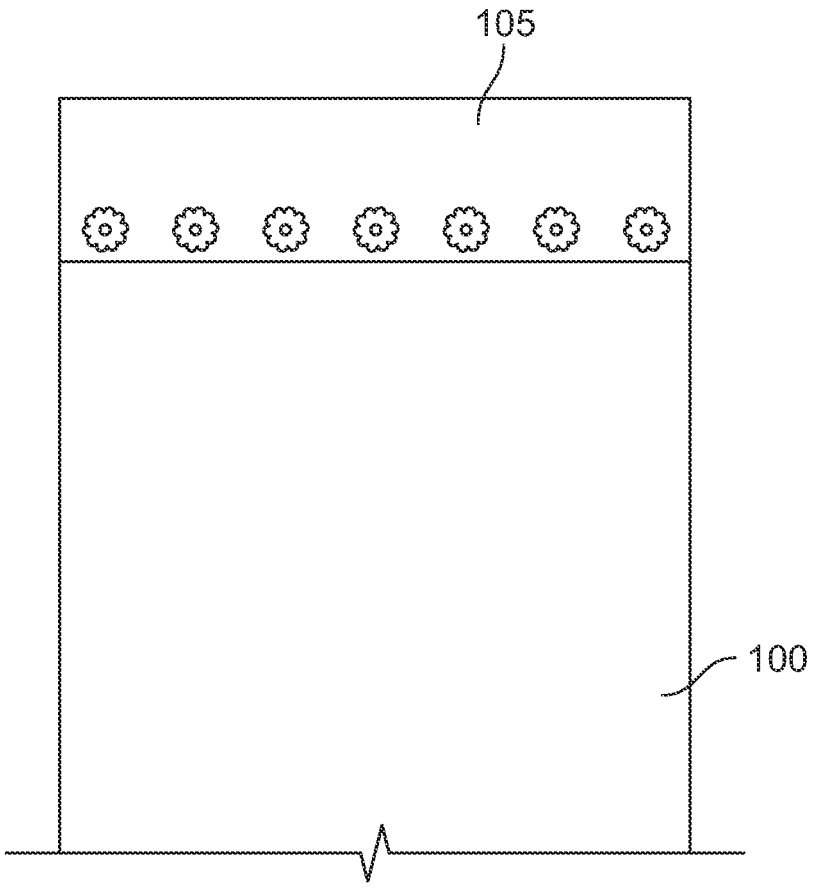

The TPS 100 in the present disclosure allows the top sheet to stay together with the comforter or blanket without being restrictive. The pocket 105 designed to hold a comforter can be made invisible or decorative according to user preference. When the pocket 105 is formed by folding over the top sheet 100 and the securing mechanisms, e.g., buttons, snap fasteners, are placed inside the pocket 105, the pocket 105 becomes blended in with the rest of the top sheet 100. The pocket can also be made decorative, thus visible, by placing the buttons outside the pocket and/or adding patterns and colors on the cover of the pocket 105, as shown in FIG. 7.

The TPS 100 disclosed in the present disclosure is convenient and easy to use. Bedsheet manufacturers can make the TPS in different ways. The TPS 100 can be made by adding a piece of fabric to a regularly sized bed sheet. The fabric may the same as or different than that of the bed sheet. Alternatively, the TPS 100 can be made by folding over a normal bed sheet. When folded over, the sheet would be shorter than a normal bed sheet. The TPS 100 can be also made using a special bed sheet that is longer than a regularly sized bed sheet. Such bed sheet may be specially made so that after being folded over to form a pocket 105, the bed sheet becomes a regularly sized bed sheet.

Although the disclosure is illustrated and described herein with reference to specific embodiments, the disclosure is not intended to be limited to the details shown. Rather, various modifications may be made in the details within the scope and range of equivalents of the claims and without departing from the disclosure.

What is claimed is:

1. A bed sheet of a rectangular shape with a top side, a bottom side, and two edges, comprising:

a buttonhole on each edge of the bed sheet and located next to the top side;

an array of buttons arranged on each edge of the bed sheet with different distances from the top side below the buttonholes; and a pocket with an opening for receiving a portion of a comforter, wherein the pocket is formed by folding over the top side of the bed sheet and fastening one of the array of buttons into the buttonhole on each edge of the bed sheet;

wherein the size of the pocket is adjustable by attaching the top side of the bed sheet to buttons at different distances on the edges of the top sheet wherein the opening of the pocket is parallel to the top side, and a size of the pocket is smaller than a size of the bed sheet and is adjustable by fastening the buttonhole on each edge to different buttons in the array of buttons on the corresponding edge, wherein when in use, the bed sheet holds the comforter in place and the comforter stays uncovered by the bed sheet stays underneath the comforter.

2. The bed sheet of claim 1, wherein the bed sheet is shorter than a regular bed sheet after one end is folded over to form the pocket.

3. The bed sheet of claim 1, wherein the bed sheet is the same size of a regular bed sheet after being folded over to form the pocket.

* * * * *